United States Patent [19]

Mifune et al.

[11] Patent Number: 4,801,524

[45] **Date of Patent: * Jan. 31, 1989**

[54] PROCESS FOR PREPARING SILVER HALIDE EMULSION AND PHOTOGRAPHIC LIGHT-SENSITIVE MATERIAL CONTAINING SAID EMULSION

[75] Inventors: Hiroyuki Mifune; Tadao Shishido; Yoshiaki Suzuki, all of Kanagawa, Japan

[73] Assignee: Fuji Photo Film Co., Ltd., Kanagawa, Japan

[ * ] Notice: The portion of the term of this patent subsequent to May 12, 2004 has been disclaimed.

[21] Appl. No.: 28,040

[22] Filed: Mar. 20, 1987

Related U.S. Application Data

[63] Continuation of Ser. No. 725,284, Apr. 19, 1985, abandoned.

[30] Foreign Application Priority Data

Apr. 19, 1984 [JP] Japan ..... 59-79161

[51] Int. Cl.[4] ..... G03C 1/06; G03C 1/02

[52] U.S. Cl. ..... 430/569; 430/611

[58] Field of Search ..... 430/567, 569, 611

[56] References Cited

U.S. PATENT DOCUMENTS

| | | | |
|---|---|---|---|
| 3,672,900 | 6/1972 | Kurz | 430/569 |
| 3,926,654 | 12/1975 | Claes | 430/568 |
| 3,957,490 | 5/1976 | Libeer et al. | 430/569 |
| 4,332,887 | 6/1982 | Gerber | 430/569 |
| 4,379,837 | 4/1983 | Lapp et al. | 430/569 |
| 4,468,454 | 8/1984 | Brown | 430/469 |
| 4,665,017 | 5/1987 | Mifune et al. | 430/569 |
| 4,678,745 | 7/1987 | Yamada et al. | 430/569 |
| 4,681,838 | 7/1987 | Mifune et al. | 430/569 |

*Primary Examiner*—Richard L. Schilling

*Attorney, Agent, or Firm*—Sughrue, Mion, Zinn, Macpeak & Seas

[57] ABSTRACT

A process for preparing a silver halide emulsion using a sulfur-containing inhibitor which substantially inhibits growth of silver halide grains is disclosed. The sulfur-containing inhibitor is inactivated by addition of an oxidizing agent capable of reducing or eliminating the inhibitory activity of the sulfur-containing inhibitor. By the process, adverse influences of the sulfur-containing inhibitor upon chemical ripening or development can be excluded.

15 Claims, No Drawings

PROCESS FOR PREPARING SILVER HALIDE EMULSION AND PHOTOGRAPHIC LIGHT-SENSITIVE MATERIAL CONTAINING SAID EMULSION

This is a continuation of application Ser. No. 725,284, filed Apr, 19, 1985, now abandoned.

FIELD OF THE INVENTION

This invention relates to a silver halide photographic light-sensitive material. More particularly, it relates to a novel process for preparing a silver halide emulsion and a silver halide photographic light-sensitive material containing the silver halide emulsion prepared by said process.

BACKGROUND OF THE INVENTION

In the production of silver halide emulsions, particularly during a precipitation step or a physical ripening step, it is common to add a compound which adsorbs onto surfaces of silver halide crystals and inhibits growth of the crystals (hereinafter simply referred to as inhibitor).

For example, an inhibitor is added in the production of silver halide light-sensitive materials requiring high resolving power, such as emulsions for IC dry plates, in order to make silver halide grains finer or to prevent formation of large grains which is likely to occur during a precipitation step.

The so-called daylight silver halide light-sensitive materials that can be handled under a bright indoor light are frequently employed for printing for the sake of improving the working environment. In this case, light-sensitive materials consisting mainly of silver chloride are produced in order to prevent increases of fog under the indoor light. Here, also, it is necessary to add an inhibitor to achieve fineness of grains and to prevent formation of large grains.

For obtaining a mono-dispersed silver halide dispersion having a narrow grain size distribution, it is necessary to apply a so-called controlled double jet (CDJ) method in which a silver halide emulsion is prepared while maintaining the silver ion concentration constant.

Since presence of even a trace amount of such an inhibitor can generally suppress formation of twins to a significant degree, and a mono-dispersed silver halide emulsion can easily be formed even under conditions of a considerably high pAg value, e.g., higher than 8.0 at 80° C., addition of the inhibitor makes it easy to obtain a mono-dispersed silver halide emulsion without using a CDJ method. It is, as a matter of course, also possible to apply a CDJ method in the presence of the inhibitor to thereby obtain a mono-dispersion having a further narrowed size distribution.

Further, as is known, e.g., based on Journal of Photographic Science, Vol. 21, p. 39 (1973), Japanese Patent Publication No. 42737/80, etc., addition of an inhibitor makes it possible in some cases to form silver halide grains having a specific crystal habit normally difficult to produce, for example, silver chloride grains or silver chloro-bromide grains having a (111) face (regular octahedrons) or a (110) face.

Furthermore, in the production of silver bromide or silver iodobromide crystals, if a mercapto-containing inhibitor is added and the silver ion concentration is kept at a certain constant level in the course of grain growing, such crystals having (110) faces (rhombic dodecahedron) in addition to (100) and (111) faces obtainable by an usual CDJ method can also be formed.

Moreover, when a silver halide emulsion is chemically ripened by sulfur sensitization, noble metal-sulfur sensitization, or the like in the presence of an inhibitor, chemical sensitization is generally suppressed, but under a specifically designed condition, such as an increased amount of sensitizer, advantages such as that contrast is increased can be attained in some cases, although the relative sensitivity is reduced.

Inhibitors that are mainly employed in the above-described situations are classified into two groups; one of which are compounds containing a nitrogen atom capable of forming crystals with silver ions and thereby adsorbing onto silver halide crystal surfaces, including benzotriazoles, benzimidazoles, hydroxytetraazaindenes, purines, etc.; the other group are compounds containing a sulfur atom capable of forming a bond with silver ions and thereby adsorbing onto silver halide crystal surfaces, including mercaptotetrazoles, mercaptotriazoles, mercaptothiadiazoles, benzothiazole-2-thiones, etc.

These inhibitors are, however, compounds that are generally known to act as antifoggants or stabilizers. Therefore, if the inhibitor is used in the preparation of silver halide emulsion grains and remains unreacted in the emulsion after washing, the residual inhibitor considerably inhibits the subsequent chemical sensitization with a chemical sensitizer and also development to the ultimate disadvantages of serious reduction of photographic density or photographic sensitivity, thus makes the product unemployable.

Further, as described above, the use of the inhibitor during chemical ripening is accompanied by a problem that sensitivity is remarkably reduced despite of improvement in fog or gradation.

An additional problem of the inhibitor is that adsorption of spectral sensitizing dyes to the silver halide grains is greatly inhibited.

Under these circumstances, it is necessary to remove the inhibitor used in the preparation of silver halide emulsions from the emulsions or inactivate it, at least by the time of coating the emulsion.

Among various inhibitors, those containing a nitrogen atom to form a bond with a silver ion can be removed from silver halide emulsions by washing the emulsion with acids or aqueous solutions of halides, since adsorption of the inhibitor to silver halide crystals can be markedly weakened by either lowering pH values or heightening pAg values.

To the contrary, it is almost impossible to weaken or eliminate the effect of the inhibitors containing a sulfur atom capable of bonding or adsorbing to silver ions by changing pH levels or using aqueous halide solutions due to conspicuously stronger bonding or adsorption of these inhibitors to silver ions.

The sulfur-containing inhibitors are suited for the purposes of fining grains, inhibiting formation of large grains, controlling crystal habits, and the like, due to their strong bonding force, but, in turn, they exhibit high inhibitory activity on development and also on adsorption of spectral sensitizing dyes, resulting in great deterioration of photographic properties. Therefore, it has been keenly desired to develop a method for reducing or removing the effects of these sulfur-containing inhibitors, to thereby eliminate the above-described various disadvantages that have been encountered in practical use.

SUMMARY OF THE INVENTION

Accordingly, an object of this invention is to provide a process for preparing a silver halide emulsion which overcomes the above-described problems encountered in using a sulfur-containing inhibitor which substantially inhibits growth of silver halide grains.

Another object of this invention is to provide a process for preparing a silver halde emulsion, which enables proper chemical ripening, spectral sensitization, etc., by suppressing adverse influences of a sulfur-containing inhibitor used in the preparation of the emulsion, and to provide a silver halide photographic light-sensitive material containing the silver halide emulsion prepared by the process.

A further object of this invention is to provide a process for preparing a silver halide emulsion wherein formation of large grains can be inhibited and silver halide grains can be made finer, and to provide a silver halide photographic light-sensitive material containing the silver halide emulsion prepared by the process.

As a result of extensive studies, it has now been found that the above objects of this invention can be accomplished by adding an oxidizing agent capable of reducing or eliminating the inhibitory activity of the sulfur-containing inhibitor when the inhibitor is used in a precipitation step, a physical ripening step, or, further, a chemical ripening step. According to this finding, the sulfur-containing inhibitor can be inactivated to thereby eliminate the above-described various disadvantages.

DETAILED DESCRIPTION OF THE INVENTION

The expression "substantially inhibit growth of silver halide grains" as used herein means that the inhibitor does not accelerate growth of grains, and more particularly, that the inhibitor can control growth of crystal habits or directly inhibit the growth of the grains.

The sulfur-containing inhibitor which can be used in the present invention refers more specifically a sulfur-containing compound which contains a mercapto group or a thioketone group and adsorbs onto crystal surfaces of silver halides via the sulfur atom and which does not substantially accelerate growth of silver chloride grains (i.e., which inhibits grain growth or does not change the grain size) in the hereinafter described test for degree of inhibition. By subjecting the inhibitors in combination with oxidizing agents to the test for degree of inhibition, suitable oxidizing agents for achieving the objects of the present invention can be selected.

Method of Test for Degree of Inhibition:

Test (1):

To Solution I kept at 70° C. is added Solution II over a period of 30 seconds, and the mixture is allowed to physically ripen for 20 minutes. Thereafter, the mixture is 11-fold diluted with water, and the apparent turbidity is determined.

| | | |
|---|---|---|
| Solution I: | Inactive gelatin | 5 g |
| | Sodium chloride | 350 mg |
| | Sodium hydroxide | proper amount to adjust to a pH of 8 |
| | Water | 55 ml |
| | Sulfur-containing inhibitor | $8 \times 10^{-5}$ mol |
| Solution II: | 0.1 N Aqueous solution of silver nitrate | 20 ml |

Since the sulfur-containing inhibitor makes the grain size smaller, the turbidity appearing in the above-described test is smaller than in the case of using no inhibitor. The sulfur-containing inhibitor is such a compound that does not change, or it decreases the turbidity, which occurs when no inhibitor is added.

Test (2):

Selection of oxidizing agents which meet the objects of the present invention can be carried out as follows:

The same procedures as in Test (1) are repeated, except that 20 minutes before the addition of Solution II to Solution I, kept at 70° C. with Sulfur-Containing Inhibitor (I-1) being used, $2 \times 10^{-2}$ mols of an oxidizing agent to be tested is added to Solution I.

If the turbidity appearing in the mixture containing (I-1) but not containing an oxidizing agent (this turbidity is, of course, smaller than in the mixture containing no inhibitor) becomes greater, i.e., if it gets closer to the turbidity which appears when (I-1) is not added, then, the tested oxidizing agent is considered to meet the objects of the present invention.

The sulfur-containing inhibitors containing a mercapto group are represented by formula (I)

$$Z—SH \qquad (I)$$

wherein Z represents an aliphatic group, such as a substituted alkyl group (e.g., a carboxyethyl group, a hydroxyethyl group, a diethylaminoethyl group, etc.), an aromatic group (e.g., a phenyl group) or a heterocyclic group (preferably a 5- or 6-membered ring). These aliphatic or aromatic groups preferably contains not more than 18 total carbon atoms.

Preferred among these groups as represented by Z are heterocyclic groups containing one or more nitrogen atoms in their ring, with the total carbon atoms being preferably 30 or less, and more preferably 18 or less.

The heterocyclic group for Z may be a condensed ring, and preferably includes imidazole, triazole, tetrazole, thiazole, oxazole, selenazole, benzimidazole, benzoxazole, benzothiazole, thiadiazole, oxadiazole, benzoselenazole, pyrazole, pyrimidine, triazine, pyridine, naphthothiazole, naphthoimidazole, naphthoxazole, azabenzimidazole, purine, azaindene (e.g., triazaindene, tetraazaindene, pentaazaindene, etc.), and the like.

Further, these heterocyclic groups or condensed rings may be substituted with appropriate substituents. Examples of the substituents are an alkyl group (e.g., a methyl group, an ethyl group, a hydroxyethyl group, a trifluoromethyl group, a sulfopropyl group, a dipropylaminoethyl group, an adamantane group, etc.), an alkenyl group (e.g., an allyl group, etc.), an aralkyl group (e.g., a benzyl group, a p-chlorophenethyl group, etc.), an aryl group (e.g., a phenyl group, a naphthyl group, a p-carboxyphenyl group, a 3,5dicarboxyphenyl group, an m-sulfophenyl group, a p-acetamidophenyl group, a 3-capramidophenyl group, p-sulfamoylphenyl group, an m-hydroxyphenyl group, a p-nitrophenyl group, a 3,5-dichlorophenyl group, a 2-methoxyphenyl group, etc.), a heterocyclic group (e.g., a pyridyl group, etc.), a halogen atom (e.g., a chlorine atom, a bromine atom, etc.), a mercapto group, a cyano group, a carboxyl group, a sulfo group, a hydroxy group, a carbamoyl group, a sulfamoyl group, an amino group, a nitro group, an alkoxy group (e.g., a methoxy group, an ethoxy group, etc.), an aryloxy group (e.g., a phenoxy group, etc.), an acyl group (e.g., an acetyl group, etc.), an acylamino group (e.g., an acetylamino group, a capramido group, a methylsulfonylamino group, etc.), a substituted amino group (e.g., a diethylamino group, a hydroxyamino group, etc.), an alkylthio or arylthio group (e.g., a methylthio group, a carboxyethylthio group, a sulfobutylthio group, etc.), an alkoxycarbonyl group (e.g., a methoxycarbonyl group, etc.), an aryloxycarbonyl group (e.g., a phenoxycarbonyl group, etc.), and the like.

The mercapto-containing compounds may be disulfides (Z—S—S—Z) that can be easily cleaved into the form of the formula (I) in the emulsion.

The sulfur-containing inhibitors containing a thioketone group are represented by formula (II)

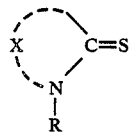

(II)

wherein R represents an alkyl group, an aralkyl group, an alkenyl group, an aryl group or a heterocyclic group; and X represents an atomic group necessary to form a 5- or 6-membered ring, which may be condensed.

The heterocyclic ring formed by X includes thiazoline, thiazolidine, selenazoline, oxazoline, oxazolidine, imidazoline, imidazolidine, thiadiazoline, oxadiazoline, triazoline, tetrazoline, pyrimidine, and the like. Condensed heterocyclic rings include benzothiazoline, naphthothiazoline, tetrahydrobenzothiazoline, benzimidazoline, benzoxazoline, and the like.

These heterocyclic groups may be substituted with substituents as enumerated for the compounds of formula (I).

The group R in the formula (II) specifically includes an alkyl group (e.g., a methyl group, a propyl group, a sulfopropyl group, a hydroxyethyl group, etc.), an alkenyl group (e.g., an allyl group, etc.), an aralkyl group (e.g., a benzyl group, etc.), an aryl group (e.g., a phenyl group, a p-tolyl group, an o-chlorophenyl group, etc.), a heterocyclic group (e.g., a pyridyl group, etc.), and the like.

Typical examples of the compounds represented by formulae (I) and (II) are shown below.

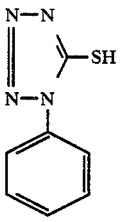

(I-1)

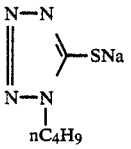

(I-2)

-continued

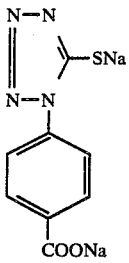

(I-3)

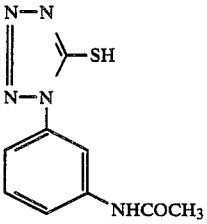

(I-4)

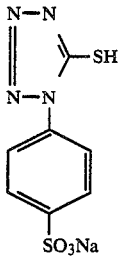

(I-5)

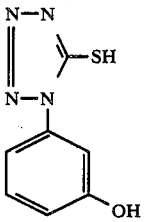

(I-6)

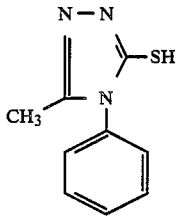

(I-7)

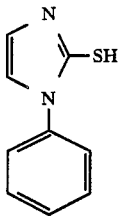

(I-8)

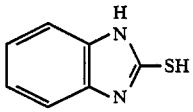

(I-9)

-continued
(I-10)
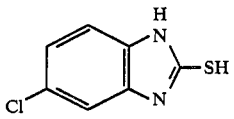
(I-11)
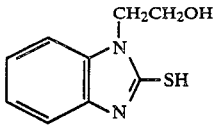
(I-12)
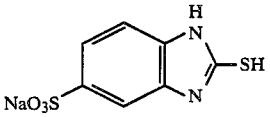
(I-13)
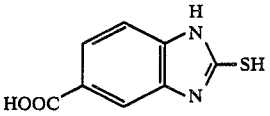
(I-14)
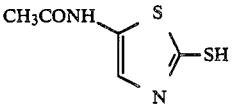
(I-15)
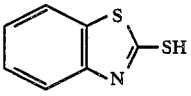
(I-16)
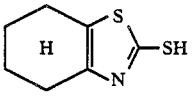
(I-17)
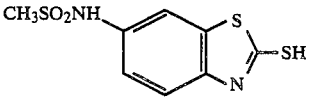
(I-18)
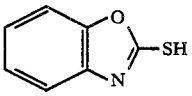
(I-19)
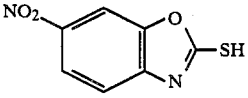
(I-20)
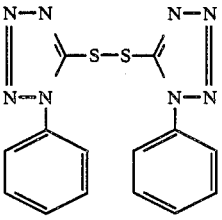
(I-21)
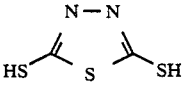
-continued
(I-22)
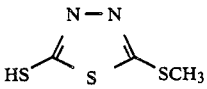
(I-23)
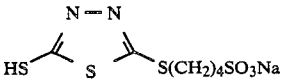
(I-24)
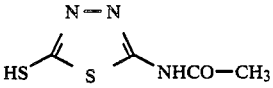
(I-25)
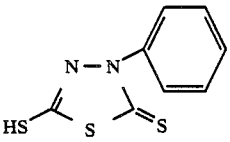
(I-26)
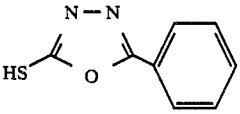
(I-27)
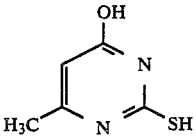
(I-28)
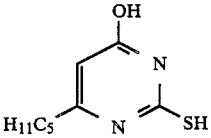
(I-29)
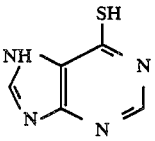
(I-30)
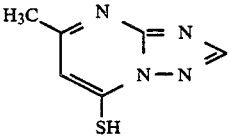
(I-31)
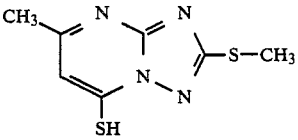
(I-32)
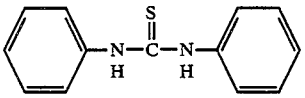
(I-33)
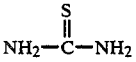
(I-34)
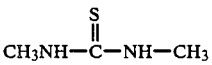

-continued

II-1

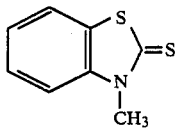

II-2

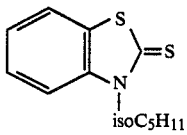

II-3

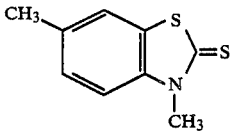

II-4

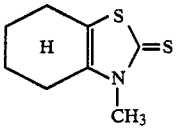

II-5

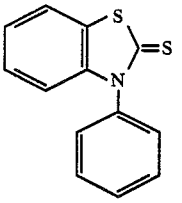

II-6

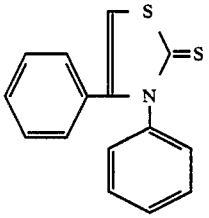

II-7

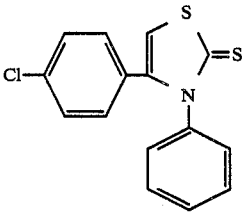

II-8

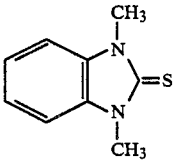

II-9

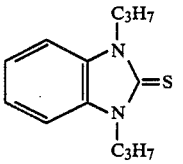

-continued

II-10

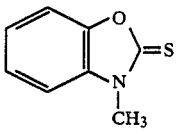

II-11

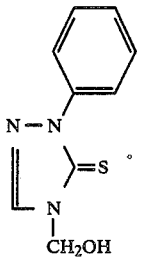

II-12

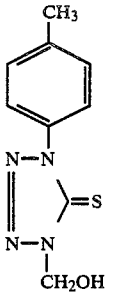

II-13

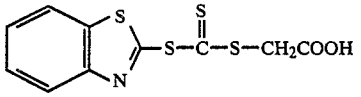

The above-described compounds can be prepared by reference to E. J. Birr, *Stabilization of Photographic Silver Halide Emulsion,* Focal Press (1974); C. G. Barlow et al., *Rep. Prog. Appl. Chem.,* Vol. 59, p. 159 (1974); *Research Disclosure*—17643 (1978); Japanese Patent Pubication Nos. 34169/73, 18008/72, and 23368/74; *Yakugaku Zasshi,* Vol. 74, pp. 1365–1369 (1954), *Beilstein,* XII, 394, ib., ibid., IV, 121; etc.

The activity of the sulfur-containing inhibitor to substantially inhibit silver halide grains from growing can be reduced or eliminated by an oxidizing agent.

Oxidizing agents that can be used include inorganic oxidizing agents and organic oxidizing agents.

The inorganic oxidizing agents specifically include oxyacid salts, such as hydrogen peroxide or an aqueous solution thereof; hydrogen peroxide adducts (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$, etc.); peroxy acid salts (e.g., $K_2S_2O_8$, $K_2C_2O_6$, $K_4P_2O_8$, etc.); peroxy complex compounds (e.g., $K_2[Ti(O_2)C_2O_4].3H_2O$; $4K_2SO_4.Ti(O_2)OH.SO_4.2H_2O$, $Na_3[VO(O_2)(C_2O_4)]_2.6H_2O$, etc.); permanganates (e.g., $KMnO_4$, etc.); chromates (e.g., $K_2Cr_2O_7$, etc.), and the like.

The organic oxidizing agents include organic peroxides, e.g., peracetic acid, perbenzoic acid, etc.

Useful oxidizing agents additionally include other oxidizing compounds, such as oxidizing gases, e.g., ozone, oxygen gas; etc.; and oxidizing compounds capable of releasing a halogen, e.g., sodium hypochlorite, N-bromosuccinimide, chloramine B (sodium benzenesulfonchloramide), chloramine T (sodium p-toluenesulfonchloramide), etc.

As described above, whether or not a particular oxidizing agent can realize the objects of this invention can be determined by the aforesaid Test (2). It is desirable to use an oxidizing agent which inactivates the sulfur-containing inhibitor, but neither decomposes gelatin nor exhibits intense desensitizing activity. Such a characteristic of oxidizing agents can also be evaluated by the aforesaid test method or by examining photographic properties in a usual manner, e.g., the tests as described in Examples 2, 3, 4, etc.

Some oxidizing agents decompose gelatin or exhibit an intense desensitizing effect. These adverse influences are particularly exerted by the halogen-releasing oxidizing agents. When such oxidizing agents are employed, they should be added in reduced quantities. Particularly when they are used after chemical ripening, the above-described adverse effects are apt to be exercised. Such being the case, it is required to reduce the amount to be added or to appropriately select a compound which does not exhibit such adverse effects.

Of the above-recited oxidizing agents, the inorganic oxidizing agents and oxidizing gases are preferred, with the inorganic oxidizing agents being particularly preferred. Of the inorganic oxidizing agents, hydrogen peroxide or adducts or precursors thereof are especially preferred.

In the present invention, the oxidizing agent may be used in the presence of a catalyst, such as sodium tungstate and metal salts (e.g., iron salts, copper salts, etc.).

The above-described oxidizing agents are mostly commercially available or can easily be synthesized by known methods.

The amount of the sulfur-containing inhibitor used can be widely varied depending on the type of the sulfur-containing inhibitor used or the time of addition, but preferably ranges from $10^{-7}$ to $10^{-1}$ mol, and more preferably from $10^{-6}$ to $10^{-2}$ mol, per mol of silver halide.

The amount of the oxidizing agent to be added varies depending on the amount of the sulfur-containing inhibitor. When complete inactivation of the inhibitor is desired, the oxidizing agent should be added in an amount at least equivalent to the amount of the inhibitor. While, when it is intended to inactivate (i.e., reduce the inhibitory activity) the inhibitor to a particular extent, the amount of the oxidizing agent to be used may be so adjusted accordingly, for example, to a range of from 1/10 to 500 molar times, preferably ⅓ to 250 molar times, the amount of the sulfur-containing inhibitor.

The sulfur-containing inhibitor or oxidizing agents is added in the form of a solution in water or a water-soluble organic solvent, e.g, alcohols, ethers, glycols, ketones, ester, amides, etc.

The addition of the oxidizing agent may be effected either before or after, and preferably after, the addition of the sulfur-containing inhibitor.

Further, the addition of the oxidizing agent may be conducted at any stage from the formation of silver halide crystals through the subsequent steps to a time immediately before coating. However, if the emulsion to which a sulfur-containing inhibitor has been added during the formation of crystal grains is subjected to chemical ripening, it is preferable to add the oxidizing agent by the time of starting the chemical ripening.

Furthermore, when a sulfur-containing inhibitor is used during chemical ripening, it is preferable to add the oxidizing agent by the time immediately before coating.

Preferred embodiments in which the sulfur-containing inhibitor and oxidizing agent are used in accordance with the present invention will be described below.

(a) A sulfur-containing inhibitor is present during the formation of silver halide emulsion grains, to thereby form an emulsion of fine grains containing no large grains, and an oxidizing agent is allowed to act by the time immediately before coating, and preferably by the start of chemical ripening.

(b) A sulfor-containing inhibitor is present during the formation of silver halide emulsion grains, to thereby form an emulsion of good mono-dispersibility, and an oxidizing agent is then allowed to act by the time immediately before coating, and preferably by the start of chemical ripening.

(c) A sulfur-containing inhibitor is present during the formation of silver halide emulsion grains to thereby form a silver halide emulsion having a specific crystal habit that is usually difficult to obtain, and an oxidizing agent is then allowed to act by the time immediately before coating, and preferably by the start of chemical ripening.

(d) A sulfur-containing inhibitor is present during chemical ripening, to thereby perform chemical ripening, and an oxidizing agent is allowed to moderately act by the time immediately before coating.

The inactivation process according to the present invention can be applied to sulfur-containing inhibitors which inhibits grain growth by coordination of sulfur atoms to silver ions.

According to the present invention, use of the above-described oxidizing agent makes it possible to reduce or eliminate the remaining of the sulfur-containing inhibitor in the system of chemical sensitization. Since the sulfur-containing inhibitor is also prevented from remaining in the development system, its inhibitory activity on development can be avoided. Further, the inhibitory activity on adsorption of various additives, such as sensitizing dyes, can also be eliminated.

When the oxidizing agent according to the present invention is used in a large quantity, a reducing material, such as a sulfite, a sulfinic acid, a reducing sugar having aldehyde or ketone groups in free form or hemiacetal form such as monosaccharides or maltose type di- or trisaccharides having reducing activity, etc., can be added at an appropriate stage to thereby inactivate any remaining oxidizing agent so that the remaining oxidizing agent may not give adverse influences upon chemical ripening or maintenance of photographic properties during preservation of light-sensitive materials. Such a reducing agent is preferably added after the addition of the oxidizing agent.

The reducing agent is used in an adequate amount according to the kind of the oxidizing agent or the desired degree of inactivation, but is usually in an amount at least equimolar to the oxidizing agent, and preferably from 1 to 50 molar times based on the oxidizing agent.

It has conventionally been known to use an oxidizing agent in the preparation of silver halide emulsions. For instance, in the production of heat-developable light-sensitive materials, it is known to use a halogen-releasing oxidizing agent in the step called halogenation for preparing silver halides from silver carboxylates. It is also known, in the production of ordinary silver halide emulsions or the above-described heat-developable light-sensitive materials, to add an oxidizing agent for the purpose of preventing fog, as described, e.g., in Japanese Patent Publication Nos. 40484/78 and 35488/79, and Japanese Patent Application (OPI) Nos. 4821/77, 10724/74 and 45718/74 (the term "OPI" as herein used means "unexamined published application"). Nevertheless, the intended objects and effects of these oxidizing agents are entirely different from those of the present invention.

Silver halides which can be used in the photographic emulsions according to the present invention may be any of silver bromide, silver iodobromide, silver iodochlorobromide, silver chlorobromide, silver iodide and silver chloride.

Grain size distribution of the photographic emulsions may be either narrow or broad.

Silver halide grains in the photographic emulsion may have a regular crystal form, such as a cube, an octahedron, a tetradecahedron, a rhombic dodecahedron, etc., an irregular crystal form, such as sphere, a plate, etc., or a composite form thereof. The grains may be a mixture of grains having various crystal forms.

The individual silver halide grains may comprise different phases or the interior (core) and the surface layer (outer-shell) may comprise a homogeneous phase.

The silver halide crystals may further include fused crystals, e.g., those wherein an oxide crystal (e.g., PbO) and a silver halide crystal (e.g., silver chloride) are fused together; epitaxially grown crystals, e.g., those comprising a silver bromide crystal on which a crystal of silver chloride, silver iodobromide, silver iodide or the like is epitaxially grown; and hexagonal octahedra of silver iodide on which hexahedra of silver chloride are orientatedly overgrown.

The photographic emulsion of the invention may have any grain size distribution of silver halide grains, or may be a mono-dispersion. The term "mono-dispersion" as herein used refers to a dispersion system which 95% of the number of the total silver halide grains is included in the size range within ±60%, and preferably within ±40%, of the number average mean grain size. The term "the number average mean grain size" is defined as a number average diameter of silver halide grains based on the projected area diameter.

The photographic emulsion of the present invention can be prepared by using the methods as described, e.g., in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. That is, the photographic emulsion can be prepared by any of the acid process, the neutral process, the ammonia process, and the like. Methods for reacting a soluble silver salt and a soluble halogen salt includes a single jet method, a double jet method and a combination thereof.

Further, a method in which silver halide grains are produced in the presence of excess silver ions (the so-called reverse mixing method) can also be employed. In addition, the so-called controlled double jet method, in which the pAg of the liquid phase wherein silver halide grains are to be precipitated is maintained constant, may be employed. According to the controlled double jet method, silver halide emulsions in which grains have a regular crystal form and an almost uniform size can be obtained.

Two or more silver halide emulsions prepared separately may be used in the form of a mixture.

In the step of silver halide grain formation or physical ripening, cadmium salts, zinc salts, lead salts, thallium salts, iridiium salts or complexes thereof, rhodium salts or complexes thereof, iron salts or complexes thereof, and the like may be present. Amounts of these compounds may be either small or large depending on the desired light-sensitive material.

If desired, conventionally known silver halide solvents, such as ammonia, potassium thiocyanate, and thioether or thione compounds as described in U.S. Pat. No. 3,271,157, Japanese Patent Application (OPI) Nos. 12360/76, 82408/78, 144319/78, 100717/79, 155828/79, etc., can be used.

After the formation of silver halide grains or physical ripening, soluble salts can be removed from the emulsion by the noodle washing method which comprises gelation of gelatin, or a sedimentation (flocculation) process using an inorganic salt, an anionic surface active agent, an anionic polymer (e.g., polystyrenesulfonic acid) or a gelatin derivative (e.g., acylated gelatin, carbamoylated gelatin, etc.).

The silver halide emulsion can be subjected to chemical sensitization if desired. Chemical sensitization can be carried out in accordance with, for example, the method described in H. Frieser, Ed., *Die Grundlagen der Photographischen Prozesse mit Silberhalogeniden,* pp. 675–734, Akademische Verlagsgesellschaft (1968).

More specifically, chemical sensitization can be effected by sulfur sensitization using compounds containing sulfur capable of reacting with active gelatin or silver ions (e.g., thiosulfates, thioureas, mercapto compounds, rhodanines, etc.); reduction sensitization using reducing materials (e.g., stannous salts, amines, hydrazine derivatives, formamidinesulfinic acid, silane compounds, etc.); noble metal sensitization using noble metal compounds (e.g., gold complexes and complexes of Periodic Table Group VIII metals, e.g., Pt, Ir, Pd, etc.) and the like individually or in combinations thereof.

Specific examples of sulfur sensitization are described in U.S. Pat. Nos. 1,574,944, 2,410,689, 2,278,947, 2,728,668, 3,656,955, etc. Specific examples of reduction sensitization are described in U.S. Pat. Nos. 2,983,609, 2,419,974, 4,054,458, etc. Specific examples of noble metal sensitization are described in U.S. Pat. No. 2,448,060, British Pat. No. 618,061, etc.

The photographic emulsions employed in the present invention can contain various compounds for the purpose of preventing fog in the preparation, storage, processing, or stabilizing photographic properties. Examples of such compounds include azoles, such as benzothiazolium salts, nitroimidazoles, triazoles, benzotriazoles, benzimidazoles (particularly, nitro- or halogen-substituted ones), etc.; heterocyclic mercapto compounds, such as mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines, etc.; the above-described heterocyclic mercapto compounds having water-soluble groups, such as a carboxyl group, a sulfo group, etc.; thioketo compounds, such as oxazolinethione, etc.; azaindenes, such as tetraazaindenes (particularly, 4-hydroxy-substituted (1,3,3a,7)-tetraazaindenes); benzenethiosulfonic acids; benzenesulfininc acid; and other various compounds known as antifoggants or stabilizers.

For details of specific examples and usages of these compounds, reference can be made to E. J. Birr, *Stabilization of Photographic Silver Halide Emulsions,* Chapters III and IV, Focal Press, (1974), and the like.

The photographic emulsion used in the light-sensitive material according to the present invention may be spectrally sensitized to blue light having relatively long wavelengths, green light, red light or infrared light by using sensitizing dyes. The sensitizing dyes which can be used include cyanine dyes, merocyanine dyes, complex cyanine dyes, complex merocyanine dyes, holopolar cyanine dyes, styryl dyes, hemicyanine dyes, oxonol dyes, hemioxonol dyes, and the like. Specific examples of the spectral sensitizing dyes are described, e.g., in P. Glafkides, *Chimie Photographique,* 2nd Ed., Chap. 35–41, Paul Montel (1957); F. M. Hamer, *The Cyanine and Related Compounds, Interscience;* U.S. Pat. Nos. 2,503,776, 3,459,553, and 3,177,210; *Research Disclosure,* Vol. 176, 17643, Item 23 IV-J (Dec., 1978), etc.

Hydrophilic colloidal layers in the light-sensitive material prepared according to the present invention can contain water-soluble dyes as filter dyes or for various purposes including prevention of irradiation. Such water-soluble dyes include oxonol dyes, hemioxonol dyes, styryl dyes, merocyanine dyes, cyanine dyes and azo dyes, with oxonol dyes, hemioxonol dyes, and merocyanine dyes being particularly useful.

The photogrphic emulsion layers and other hydrophilic colloidal layers of the photographic light-sensitive material of the present invention can contain an inorganic or organic hardener. Examples of usable hardeners are chromates, e.g., chromium alum, chromium acetate, etc.; aldehydes, e.g., formaldehyde, glyoxal, glutaraldehyde, etc.; N-methylol compounds, e.g., dimethylolurea, methyloldimethylhydantoin, etc.; dioxane derivatives, e.g., 2,3-dihydroxydioxane, etc.; active vinyl compounds, e.g., 1,3,5-triacryloyl-hexahydro-s-triazine, 1,3-vinylsulfonyl-2-propanol, etc.; active halogen compounds, e.g., 2,4-dichloro-6-hydroxy-s-triazine, etc.; mucohalogenic acids, e.g., mucochloric acid, mucophenoxychloric acid, etc.; and the like, either alone or in combinations thereof.

The photographic emulsion layer or other hydrophilic colloidal layers of the light-sensitive material of the present invention may contain various surface active agents for a wide variety of purposes, such as aid in coating, prevention of static charge, improvement of slipping property, aid in emulsifying and dispersing, prevention of adhesion, improvement in photographic properties (e.g., acceleration of development, increase of contrast, and increase of sensitivity), and the like.

Specific examples of the surface active agents which can be used include nonionic surface active agents, such as saponin (steroid type), alkylene oxide derivatives (e.g., polyethylene glycol, polyethylene glycol/polypropylene condensates, polyethylene glycol alkyl ethers or alkylaryl ethers, polyethylene glycol esters, polyethylene glycol sorbitan esters, polyalkylene glycol alkylamines or amides, polyethylene oxide adducts of silicon, etc.), glycidol derivatives (e.g., alkenylsuccinic polyglycerides, alkylphenol polyglycerides, etc.), fatty acid esters of polyhydric alcohols, alkyl esters of sugars, etc.; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

For the purpose of increasing sensitivity or contrast or accelerating development, the photograhic emulsion layers of the photographic light-sensitive material according to the present invention may contain, for example, polyalkylene oxides or derivatives thereof (e.g., ethers, esters, amines, etc.), thioether compounds, thiomorpholines, quaternary ammonium salt compounds, urethane derivatives, urea derivatives, imidazole derivatives, 3-pyrazolidones, and the like.

Binders or protective colloids which can be used in the emulsion layers or intermediate layers of the light-sensitive material according to the present invention include advantageously gelatin, but other hydrophilic colloids may also be employed.

Examples of usable hydrophilic colloids can include proteins, such as gelatin derivatives, graft polymers of gelatin with other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; a wide variety of synthetic hydrophilic high molecular weight substances, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. and copolymers thereof.

The photographic emulsion layers of the photographic light-sensitive material according to the present invention can contain color-forming couplers, i.e., compounds capable of forming colors upon oxidative coupling with aromatic primary amine developing agents (e.g., phenylenediamine derivatives and aminophenol derivatives) in color development processing. Examples of conventional magenta couplers include 5-pyrazolone couplers, pyrazolobenzimidazole couplers, cyanoacetylcumarone couplers, open-chain acylacetonitrile couplers, and the like. Examples of yellow couplers include acylacetamide couplers (e.g., benzoyl acetanilides, pivaloyl acetanilides, etc.) and the like. Examples of cyan couplers include naphthol couplers, phenol couplers, and the like. These couplers desirably contain hydrophobic groups called ballast groups in their molecules and are thereby rendered non-diffusible. The couplers may be 4-equivalent or 2-equivalent with respect to silver ions. Moreover, they may be colored couplers having a color correcting effect, or couplers capable of releasing development restrainers upon development (so-called DIR couplers).

In addition to conventional dye-forming DIR couplers, the emulsion may contain conventional colorless (non-dye-forming) DIR coupling compounds which yield colorless products upon coupling and release development restrainers as described in *Research Disclosure,* No. 176, p. 25, Paragraph F (RD-17643) (Dec. 1978).

The light-sensitive materials according to the present invention may contain hydroquinone derivatives, aminophenol derivatives, gallic acid derivatives, ascorbic acid derivatives, and the like as color fog preventing agents.

The light-sensitive materials of the present invention may further contain, in their hydrophilic colloidal layers, ultraviolet absorbents. The ultraviolet absorbents which can be used include benzotriazole compounds substituted with aryl groups, e.g., those disclosed in U.S. Pat. No. 3,533,794; 4-thiazolidone compounds, e.g., those disclosed in U.S. Pat. Nos. 3,314,794 and 3,352,681; benzopheone compounds, e.g., those disclosed in Japanese Patent Application (OPI) No. 2784/71; cinnamic ester compounds, e.g., those disclosed in U.S. Pat. Nos. 3,705,805 and 3,707,375; butadiene compounds, e.g., those disclosed in U.S. Pat. No. 4,045,229; and benzoxazole compounds, e.g., those disclosed in U.S. Pat. No. 3,700,455. Additionally, the compounds as described in U.S. Pat. No. 3,499,762 and Japanese Patent Application (OPI) No. 48535/79 can also be employed. Ultraviolet absorbing couplers, e.g., cyanforming couplers of α-naphthol type, or ultraviolet absorbing polymers may also be used. These ultraviolet absorbents may be fixed in a specific layer.

In carrying out the present invention, the following known discoloration inhibitors may also be used. Color image stabilizers which can be used in the present invention may be used alone or in combinations of two or more thereof. Known discoloration inhibitors include hydroquinone derivatives, gallic acid derivatives, p-alkoxyphenols, p-oxyphenol derivatives, bisphenols, and the like.

The silver halide photographic emulsion in accordance with the present invention may further contain various additives, such as brightening agents, desensitizers, plasticizers, slipping agents, matting agents, oils (high boiling organic solvents), mordants, and the like. Specific examples of these additives are described, e.g., in *Research Disclosure,* No. 176, pp. 22-31 (RD-17643) (Dec., 1978), etc.

The emulsions according to the present invention can be applied to various kinds of color and black-and-white silver halide light-sensitive materials. More specifically, the emulsions can be applied to color positive film, color paper, color negative film, color reversal film (some contain couplers, and some not), light-sensitive materials for photomechanical process (e.g., lith film), light-sensitive materials for cathode-ray tube display, light-sensitive materials for X-ray recording (particularly direct and indirect photographic materials using a screen), light-sensitive materials for a colloid transfer process, a silver salt diffusion transfer process, a dye transfer process or a silver dye bleach process, print-out light-sensitive materials, heat-developable light-sensitive materials, and the like.

Exposure for obtaining a photographic image can be effected in a conventional manner. More specifically, light sources which can be used include natural light (sunlight), a tungsten lamp, a fluorescent lamp, a mercury lamp, a xenon arc lamp, a carbon arc lamp, a xenon flash lamp, a cathode-ray tube flying spot, a light-emitting diode, a laser beam (e.g., gas laser, YAG layer, dye laser, semi-conductor laser, etc.) and other various known light sources containing infrared light. Exposure can also be carried out by light emitted from fluorescent substances excited by electron rays, X-rays, γ-rays, α-rays, etc.

Suitable exposure times which can be used include not only exposure times commonly employed in cameras, generally ranging from 1/1,000 to about 1 second, but also exposure times shorter than 1/1,000 second, e.g., about $1/10^4$ to $1/10^6$ second as with xenon flash lamps or cathode-ray tubes. Exposure times lower than 1 second can also be used. The spectral composition of the light used for the exposure can be controlled using color filters, if desired.

Known methods and processing solutions as described, e.g., in *Research Disclosure,* No. 176, pp. 28-30 (RD-17643), can be applied to photographic processing of the light-sensitive materials according to the present invention. Any photographic processing, whether for the formation of silver images (black-and-white processing) or for the formation of dye images (color photographic processing), can be used depending on the end use of the light-sensitive material. The processing temperature is generally selected from range of from 18° to 50° C. Temperatures out of this range may also be employed.

The present invention will now be illustrated in greater detail by reference to examples, but these examples are not to be deemed to limit the present invention.

EXAMPLE 1

To Solution I having the following composition maintained at 45° C. under vigorous stirring, 800 ml of an aqueous solution containing 120 g of silver nitrate and 800 ml of a mixed aqueous solution containing 40.4 g of sodium chloride and 1.7 g of potassium bromide were added simultaneously over 10 minutes to prepare a silver chlorobromide emulsion having a silver bromide content of 2 mol%.

| | | |
|---|---|---|
| Solution I: | Inactive gelatin | 20 g |
| | Sodium chloride | 250 mg |
| | Rhodium chloride | 7.4 mg |
| | Water | 1 liter |
| | Sulfur-containing inhibitor | 0 to 300 mg per 0.71 mol of $AgNO_3$ |

The resulting silver chlorobromide emulsion was divided into 2 or 3 portions. One of the two or three divided portions was used as it was, and to the other one or two portions was added an oxidizing agent according to the present invention as shown in Table 1, followed by stirring for 40 minutes. Each of the emulsions was sampled and examined for the grain size and the presence of coarse grains by an electron microscope. The results obtained are shown in Table 1.

Each of the above-described emulsion was washed with water in a conventional manner, and a stabilizer (1.4 g of 4-hydroxy-6-methyl-1,3,3a,7-tetraazaindene), a hardener (1.8 g of sodium 2,4-dichloro-6-hydroxy-s-triazine), and a coating aid (0.4 g of sodium dodecylbenzenesulfonate) were then added thereto. The resulting emulsion was coated on a polyethylene terephthalate film support to provide a silver coverage of 2.5 g/m$^2$, and dried to obtain Sample Nos. 1 to 18.

Each of the samples was sufficiently exposed to light through an optical wedge using a mercury lamp, developed with a developer D-72 (formulated by Eastman Kodak Co.) having the following composition at 27° C. for 2 minutes and 10 seconds, and then subjected to conventional processing, i.e., stopping, fixing, washing, and drying. The maximum density ($D_{max}$) of the resulting image was determined, and the results obtained are shown in Table 1.

| Developer D-72 | |
|---|---|
| Water (at about 50° C.) | 750 ml |
| Elon | 3 g |
| Anhydrous sodium sulfite | 45 g |

-continued

| Developer D-72 | |
|---|---|
| Hydroquinone | 12 g |
| Sodium carbonate monohydrate | 80 g |
| (or Anhydrous potassium carbonat | 67.5 g) |
| Potassium bromide | 2 g |
| Water to make | 1000 ml |

TABLE 1

| Sample No. | Sulfur-Containing Inhibitor (Amount Added)* | | Oxidizing Agent (Amount Added)* | Mean Grain Size (μm) | Presence of Coarse Grain | Maximum Density |
|---|---|---|---|---|---|---|
| 1 | — | | — | 0.28 | Many | 3.2 |
| 2 | (I-1) | (90 mg) | — | 0.21 | Almost none | 3.4 |
| 3 | " | " | $H_2O_2$ (35%) (6 ml) | " | " | 3.9 |
| 4 | " | (160 mg) | — | 0.15 | None | 3.6 |
| 5 | " | " | $H_2O_2$ (35%) (6 ml) | " | " | 4.2 |
| 6 | (I-7) | (160 mg) | — | 0.18 | " | 3.5 |
| 7 | " | " | $K_2S_2O_8$ (2.6 g) | " | " | 4.0 |
| 8 | (I-9) | (80 mg) | — | 0.21 | Almost none | 3.3 |
| 9 | " | " | $NaBO_2H_2O_23H_2O$ (6.2 g) | " | " | 3.7 |
| 10 | (I-24) | (210 mg) | — | 0.13 | None | 3.5 |
| 11 | " | " | $H_2O_2$ (35%) (5 ml) | " | " | 4.4 |
| 12 | (II-1) | (250 mg) | — | 0.19 | " | 3.6 |
| 13 | " | " | $H_2O_2$ (35%) (6 ml) | " | " | 4.1 |
| 14 | (II-4) | (300 mg) | — | 0.18 | " | 3.6 |
| 15 | " | " | N—Chlorosucinimide (4.5 g) | " | " | 3.8 |
| 16 | (II-9) | (180 mg) | — | 0.21 | None | 3.3 |
| 17 | " | " | $H_2O_2$ (35%) (4 ml) | " | " | 3.7 |
| 18 | " | " | Chloramine T (6.5 g) | " | " | 3.5 |

Note
*per 0.71 mol of $AgNo_3$

This example relates to the preparation of silver halide light-sensitive materials suitable for room light handling. These materials should mainly comprise silver chloride for increasing the safety of safelight exposure, and have fine silver halide grains for increasing a maximum density.

However, as is apparent from Table 1, it is difficult to make the grain size of silver chloride smaller, and also that coarse grains are likely to be formed when produced by a conventional method, such as a rapid addition process. Although addition of a sulfur-containing inhibitor at the time of the formation of grains has the advantage of making the grain size smaller and conspicuously reducing coarse grains, the sulfur-containing inhibitor cannot be removed from the emulsion by washing with water and the like, and the remaining sulfur-containing inhibitor inhibits development, resulting in reduction of the maximum density.

The results set forth in Table 1 indicate that the sulfur-containing inhibitor can be removed or inactivated by the use of an oxidizing agent according to the present invention, thus remarkably increasing the maximum density.

EXAMPLE 2

Aqueous ammonia was added to an aqueous gelatin solution maintained at 50° C. while vigorously stirring. A silver nitrate aqueous solution and a mixed aqueous solution of potassium bromide and potassium iodide were simultaneously added thereto over 30 minutes to obtain a silver iodobromide emulsion having an iodine content of 1 mol%. Five minutes after starting the addition of the silver nitrate solution, the sulfur-containing compound in the amount shown in Table 2 was added to the emulsion. The oxidizing agent shown in Table 2 was added to the mixture immediately before the end of the addition of the silver nitrate aqueous solution. Since the grain size becomes smaller by the addition of the sulfur-containing inhibitor, the amount of ammonia to be added was adjusted so as to result in a grain size of 0.48 μm. After washing the emulsion with water, sodium benzenesulfinate was added thereto, to thereby inactivate any remaining oxidizing agent, followed by washing with water. The emulsion was adjusted to a pH of 6.4 and to a pAg of 8.8, and then chemically ripened using sodium thiosulfate, potassium thiocyanate, and potassium chloroaurate.

To the resulting emulsion were added the same stabilizer, hardener, and coating aid as used in Example 1 in the same amounts as in Example 1, and the emulsion was then coated on a cellulose triacetate film support and dried to obtain Sample Nos. 20 to 26.

Each of the samples was exposed to light through an optical wedge, developed with a developer D-19 (formulated by Eastman Kodak Co.) having the following composition at 20° C. for 4 minutes and subjected to conventional processing procedures of stopping, fixing, washing, and drying. The results obtained are shown in Table 2.

| Developer D-19 | |
|---|---|
| Water | 500 ml |
| Elon | 2 g |
| Anhydrous sodium sulfite | 90 g |
| Hydroquinone | 8 g |
| Sodium carbonate monohydrate | 52.5 g |
| Potassium bromide | 5 g |
| Water to make | 1000 ml |

In Table 2, "relative sensitivity" is represented by a relative value of the reciprocal of an exposure necessary to give a density of "fog+0.5", taking the sensitivity of Sample No. 20 as 100. "Gradation at Toe" is represented by a difference between a logarithm of the exposure necessary to give a density of "fog+0.1" and that necessary to give a density of "fog+0.5". The smaller this difference, the harder is the gradation at the toe part of the sensitivity curve.

TABLE 2

| Sample No. | Sulfur-Containing Inhibitor (Amount Added)* | | Oxidizing Agent (Amount Added)* | Mean Grain Size (μm) | Standard Deviation of Grain size | Presence of Coarse Grain | Relative Sensitivity | Gradation at Toe |
|---|---|---|---|---|---|---|---|---|
| 20 | — | | — | 0.48 | 0.14 | Many | 100 (standard) | 0.35 |
| 21 | (I-1) | (30 mg) | — | 0.48 | 0.09 | None | 40 | 0.55 |
| 22 | " | " | $H_2O_2$ (35%) (4 ml) | " | " | " | 90 | 0.25 |
| 23 | " | " | Chloamine T (5.5 g) | " | " | " | 82 | 0.27 |
| 24 | (I-15) | (30 mg) | — | 0.48 | 0.09 | " | 35 | 0.55 |
| 25 | " | " | $H_2O_2$ (35%) (4 ml) | " | " | " | 85 | 0.25 |
| 26 | (II-4) | (60 mg) | — | 0.48 | 0.10 | " | 50 | 0.45 |
| 27 | " | " | $H_2O_2$ (35%) (6 ml) | " | " | " | 95 | 0.30 |

Note
*per 0.59 mol of $AgNO_3$

As can be seen from Table 2, addition of a sulfur-containing inhibitor prevents formation of coarse grains and affords a narrow grain size distribution.

However, the use of the sulfur-containing inhibitor alone causes retardation of chemical ripening and inhibition on development due to the residual sulfur-containing inhibitor, which result in poor gradation at the toe part and a serious reduction in the sensitivity.

According to the present invention, use of the oxidizing agent in combination with the sulfur-containing inhibitor can inactivate the sulfur-containing inhibitor used during the formation of grains so that the adverse influences of the sulfur-containing inhibitor on chemical ripening and development can be excluded to thereby simultaneously improve gradation at the toe and sensitivity.

EXAMPLE 3

To each of the chemically ripened emulsions used in Sample Nos. 21, 22, 26, and 27 of Example 2 were successively added sodium 5,5'-dichloro-9-ethyl-3,3'-di(3-sulfopropyl)oxacarbocyanine as a sensitizing dye in an amount of 325 mg per kg of the emulsion, 1-(2,4,6-trichlorophenyl)-3-[3-(2,4-di-t-amylphenoxyacetamido)-benzamido]-5-pyrazolone as a magenta coupler in an amount of 46.7 g per kg of the emulsion, 4-hydroxy-6-methyl-1,3,3a,7,-tetraazaindene as a stabilizer in an amount of 1.8 g per kg of the emulsion, 1,3-bis-vinylsulfonylhydroxypropane as a hardener in an amount of 1.8 g per kg of the emulsion, and sodium p-dodecylbenzenesulfonate and sodium p-nonylphenoxypoly(ethyleneoxy)propanesulfonate as coating aids, each in an amount of 0.2 g per kg of the emulsion, and the resulting emulsion was coated on a cellulose acetate film support and dried to obtain Sample Nos. 30 to 33.

Each of the samples was exposed to light through an optical wedge and subjected to the following color development processing at 38° C. throughout. The results obtained are shown in Table 3.

| Development Processing: | |
|---|---|
| 1. Color development | 1 min. 30 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilization | 3 min. 15 sec. |

The processing solution used in the noted steps had the following compositions:

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleaching Solution: | |
| Ammonium bromide | 160.0 g |
| Aqueous ammonia (28 wt %) | 25.0 ml |
| Sodium (ethylenediaminetetra-acetate) iron | 130.0 g |
| Glacial acetic acid | 14.0 ml |
| Water to make | 1 liter |
| Fixing Solution: | |
| Sodium tetrapolyphosphate | 2.0 g |
| Sodium sulfite | 4.0 g |
| Ammonium thiosulfate (70 wt %) | 175.0 ml |
| Sodium bisulfite | 4.6 g |
| Water to make | 1 liter |
| Stabilizer: | |
| Formalin (37 wt % aqueous formaldehyde solution) | 8.0 ml |
| Water to make | 1 liter |

TABLE 3

| Sample No. | Emulsion | Relative Sensitivity | Remark |
|---|---|---|---|
| 30 | Sample 21 | 100 (standard) | Comparison |
| 31 | Sample 22 | 320 | Invention |
| 32 | Sample 26 | 120 | Comparison |
| 33 | Sample 27 | 335 | Invention |

As is apparent from Table 3, Sample Nos. 31 and 33, wherein the sulfur-containing inhibitors were inactivated by the oxidizing agents did not undergo hinderance of the sulfur-containing inhibitor to adsorption of the sensitizing dye, and, therefore, the emulsions could be spectrally sensitized to a satisfactory degree as compared with Sample Nos. 30 and 32, in which no oxidizing agent was used.

EXAMPLE 4

A silver iodobromide emulsion containing regular octahedral grains having a mean grain size of 0.65 μm and having an iodide content of 1 mol% was prepared according to a CDJ (i.e., controlled double jet) method. The emulsion was washed in a usual manner, and after adjusting to a pH of 6.3 and to a pAg of 9.0, the sulfur-containing inhibitor shown in Table 4 was added thereto. The emulsion was then chemically ripened by using sodium thiosulfate, potassium thiocyanate, and potassium chloroaurate at 60° C. under optimum conditions so as to attain the hardest gradation.

The oxidizing agent shown in Table 4 was added to the emulsion at the end of the chemical ripening, followed by continuing ripening for an additional 20 minutes. Six millimols of sodium benzenesulfinate was then added thereto to thereby inactivate any remaining oxidizing agent.

The same additives as used in Example 1 were added to the emulsion in the same amounts as in Example 1, and the resulting coating emulsion was coated on a cellulose acetate film support and dried to obtain samples.

Each of the samples was exposed to white light through an optical wedge and developed with a developer D-19 of Eastman Kodak Co. at 20° C. for 4 minutes to obtain the results as shown in Table 4.

TABLE 4

| Sulfur-Containing Inhibitor | | Oxidizing Agent | | Relative |
|---|---|---|---|---|
| (Amount Added)* | | (Amount Added)* | Gamma | Sensitivity |
| — | | — | 2.1 | 100 (standard) |
| (I-1) | (75 mg) | — | 3.6 | 25 |
| " | " | $H_2O_2$ (35%) (0.5 ml) | 3.2 | 60 |
| (I-22) | (60 mg) | — | 3.3 | 18 |
| " | " | $H_2O_2$ (35%) (0.3 ml) | 2.8 | 55 |

Note
*per mole of AgX

It can be seen from Table 4 that chemical ripening tends to be inhibited when conducted in the presence of a sulfur-containing inhibitors as compared with the case when no sulfur-containing inhibitor is used. Although use of an increased amount of chemical sensitizers produces harder gradation, such chemical ripening also tends to lead to a considerable reduction of the relative sensitivity. However, when the oxidizing agent according to the present invention is added at the final stage of chemical ripening, the relative sensitivity can be restored to an appreciable extent although accompanying slight softening of gradation.

EXAMPLE 5

A silver bromide emulsion (seed emulsion) containing regular octahedral grains having a mean grain size of 0.85 μm was prepared by using aqueous ammonia in accordance with a CDJ method wherein pAg was maintained at 9.2

In 1,000 ml of warm water at 50° C. was dissolved 350 g of the seed emulsion (corresponding to 35 g of silver nitrate and containing 26 g of gelatin), and the sulfur-containing inhibitor shown in Table 5 was added thereto. Then, a silver nitrate aqueous solution containing 75 g of silver nitrate and a potassium bromide aqueous solution were simultaneously added thereto while maintaining the pAg at 9.8. Aqueous ammonia was also added in order to deposit all silver bromide on the seed crystals without causing renucleation. The thus obtained emulsion grains were silver bromide rhombic dodecahedra composed of (110) faces.

After the addition of the silver nitrate aqueous solution, the oxidizing agent shown in Table 5 was added thereto, followed by stirring for 40 minutes, and then washing with water in a conventional manner. The emulsion was adjusted to a pH of 6.8 and to a pAg of 8.9 and then subjected to gold-sulfur sensitization using sodium thiosulfate, potassium thiocyanate and potassium chloroaurate.

To the emulsion thus obtained were successively added the same additives as used in Example 3 excluding the sensitizing dye in the same amounts as in Example 3, and the resulting coating emulsion was coated on a cellulose acetate film support and dried to obtain samples.

The samples were exposed to white light through an optical wedge and development-processed in the same manner as in Example 3. The results obtained are shown in Table 5.

TABLE 5

| Sulfur-Containing Inhibitor (Amount Added)* | | Oxidizing Agent (Amount Added)* | Crystal Habit | Mean Grain Size (μm) | Relative Sensitivity |
|---|---|---|---|---|---|
| (I-1) | (60 mg) | — | rhombic dodecahedral | 1.3 | 100 (standard) |
| " | " | $H_2O_2$ (35%) (2 ml) | " | " | 350 |
| " | " | $K_2S_2O_8$ (3.3 g) | " | " | 280 |

Note
*per 0.65 mol of AgX

An inhibitor like (I-1) is essential in the formation of silver bromide rhombic dodecahedral grains composed of (110) faces, but this compound can not be removed by washing with water, and thus results in unfavorable inhibition of chemical ripening and development if used alone.

However, as can be seen from Table 5, (I-1) is inactivated by the use of the oxidizing agent after the formation of grains according to the present invention, thereby achieving a conspicuous increase (i.e., restoration) of sensitivity.

EXAMPLE 6

Regular octahedral grains of silver chloride were formed using Sulfur-Containing Inhibitor (I-33) or (I-34) in accordance with the method described in *Journal of Photographic Science,* Vol. 21, pp. 39–50 (1973) (conventional methods fail to produce octahedral grains of silver chloride).

Since (I-33) and (I-34) are both compounds also serving as sulfur sensitizers, fog was generated. However, (I-33) and (I-34) could be inactivated by adding an oxidizing agent according to the present invention, and generation of fog could be comparatively suppressed.

While the invention has been described in detail and with reference to specific embodiments thereof, it will be apparent to one skilled in the art that various changes and modifications can be made therein without departing from the spirit and scope thereof.

What is claimed is:

1. A process for preparing a silver halide emulsion using a sulfur-containing inhibitor which substantially inhibits growth of silver halide grains, said sulfur-containing inhibitor being used in the formation of silver halide grains and wherein an inorganic oxidizing agent capable of reducing or eliminating the inhibitory activity of the sulfur-containing inhibitor is added to the silver halide emulsion by the start of chemical ripening to reduce or eliminate the inhibitory activity of the sulfur-containing inhibitor said sulfur-containing inhibitor being a mercapto-containing compound represented by formula (I)

Z—SH (I)

wherein Z represents an aliphatic group, an aromatic group, or a heterocyclic group, or a thicketone-containing compound represented by formula (II)

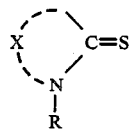

wherein R represents an alkyl group, an aralykyl group, an alkenyl group, an aryl group or a heterocyclic group; and X represents an atomic group forming a 5- or 6-membered ring.

2. A process as in claim 1, wherein the sulfur-containing inhibitor is a mercapto-containing compound represented by formula (I)

Z—SH (I)

wherein Z represents an aliphatic group, an aromatic group, or a heterocyclic group.

3. A process as in claim 1, wherein said heterocyclic group in formula (I) is a nitrogen-containing heterocyclic group having not more than 30 total carbon atoms, and each of said aliphatic group and said aromatic group has not more than 18 total carbon atoms.

4. A process as in claim 1, wherein the sulfur-containing inhibitor is a thioketone-containing compound represented by formula (II)

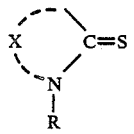

(II)

wherein R represents an alkyl group, an aralkyl group, an alkenyl group, an aryl group or a heterocyclic group; and X represents an atomic group forming a 5- or 6-membered ring.

5. A process as in claim 1, wherein the inorganic oxidizing agent is hydrogen peroxide or an adduct or precursor thereof.

6. A process as in claim 1, wherein the oxidizing agent is an oxidizing gas.

7. A process as in claim 1, wherein the sulfur-containing inhibitor is used in an amount of from $10^{-7}$ to $10^{-1}$ mol per mol of silver halide.

8. A process as in claim 1, wherein the sulfur-containing inhibitor is used in an amount of from $10^{-6}$ to $10^{-2}$ mol per mol of silver halide.

9. A process as in claim 1, wherein the oxidizing agent is added after the addition of the sulfur-containing inhibitor.

10. A process as in claim 1, wherein a reducing agent is added.

11. A process as in claim 10, wherein the reducing agent is added after the addition of the oxidizing agent.

12. A process as in claim 10, wherein the reducing agent is a sulfite, a sulfinic acid, or a reducing sugar.

13. A process as in claim 1, wherein the oxidizing agent is present in a range of from 1/10 to 500 molar times the amount of the sulfur-containing inhibitor.

14. A process as in claim 1, wherein the sulfur-containing inhibitor is a mercapto-containing compound that adsorbs onto crystal surfaces of silver halides via the sulfur atom of said mercapto group, or is a thioketone group-containing compound which adsorbs onto crystal surfaces of silver halide via the sulfur atom of said thioketone group.

15. The process of claim 1, wherein the amount of said oxidizing agent is sufficient to decrease turbidity of a test solution as determined by the following test procedure:

Test (1):

to Solution I kept at 70° C. is added Solution II over a period of 30 seconds, and the mixture is allowed to physically ripen for 20 minutes, thereafter, the mixture is 11-fold diluted with water, and the apparent turbidity is determined;

| | | |
|---|---|---|
| Solution I: | Inactive gelatin | 5 g |
| | Sodium chloride | 340 mg |
| | Sodium hydroxide | proper amount to adjust to a pH of 8 |
| | Water | 55 ml |
| | Sulfur-containing inhibitor (I-1) | $8 \times 10^{-5}$ mol |
| Solution II: | 0.1 N Aqueous solution of silver nitrate | 20 ml |

Test (2):

the same procedures as in Test (1) are repeated, except that 20 minutes before the addition of Solution II to Solution I, kept at 70° C. with Sulfur-Containing Inhibitor (I-1) being used, $2 \times 10^{-2}$ mols of an oxidizing agent to be tested is added to Solution I, wherein Compound I-1 is

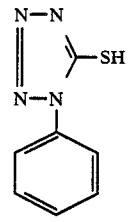

* * * * *